US008950291B1

(12) United States Patent
Coleman

(10) Patent No.: US 8,950,291 B1
(45) Date of Patent: Feb. 10, 2015

(54) THREE-FUNCTION BEVERAGE-CONTAINER OPENER DEVICE

(71) Applicant: Doug Coleman, Union Grove, WI (US)

(72) Inventor: Doug Coleman, Union Grove, WI (US)

( * ) Notice: Subject to any disclaimer, the term of this patent is extended or adjusted under 35 U.S.C. 154(b) by 179 days.

(21) Appl. No.: 13/715,284

(22) Filed: Dec. 14, 2012

Related U.S. Application Data

(60) Provisional application No. 61/576,285, filed on Dec. 15, 2011.

(51) Int. Cl.
*B67B 7/44* (2006.01)

(52) U.S. Cl.
CPC ..... *B67B 7/44* (2013.01)
USPC ..... 81/3.09

(58) Field of Classification Search
CPC ..... B67B 7/14; B67B 7/16; B67B 7/403; B67B 7/44
USPC ..... 81/3.09, 3.55
See application file for complete search history.

(56) References Cited

U.S. PATENT DOCUMENTS

| | | | | |
|---|---|---|---|---|
| 4,253,352 | A | | 3/1981 | O'Neal |
| 4,309,921 | A | | 1/1982 | Miller |
| 4,373,223 | A | | 2/1983 | Miller |
| 4,391,167 | A | | 7/1983 | Bergmeister |
| 4,409,863 | A | | 10/1983 | Anderson |
| 4,412,464 | A | | 11/1983 | Cook |
| 4,414,865 | A | | 11/1983 | Brooks et al. |
| 4,416,171 | A | | 11/1983 | Chmela et al. |
| 4,455,894 | A | | 6/1984 | Roberts |
| 4,474,087 | A | | 10/1984 | Widman |
| D277,725 | S | | 2/1985 | Silkebakken |
| 4,507,988 | A | | 4/1985 | LoFaso et al. |
| 4,549,451 | A | | 10/1985 | Widman |
| D282,714 | S | | 2/1986 | Harvey |
| 4,583,429 | A | | 4/1986 | Kroeger |
| 4,607,407 | A | | 8/1986 | Bergmeister |
| 4,660,446 | A | * | 4/1987 | Soltis ..... 81/3.55 |
| 4,723,465 | A | | 2/1988 | Hughes |
| 4,846,024 | A | | 7/1989 | Bryant et al. |
| 4,911,038 | A | | 3/1990 | Ferrin |
| 4,923,392 | A | * | 5/1990 | Moynihan, III ..... 431/253 |
| 4,967,622 | A | | 11/1990 | Phillips |
| 4,979,407 | A | | 12/1990 | Hernandez et al. |
| 5,165,579 | A | | 11/1992 | Lund |
| 5,169,305 | A | | 12/1992 | Kee |
| 5,277,083 | A | | 1/1994 | Madonia |
| 5,771,759 | A | | 6/1998 | Warren |
| 5,911,794 | A | * | 6/1999 | Nordhoff ..... 81/3.55 |
| 6,070,497 | A | | 6/2000 | Farelli |
| 6,098,830 | A | | 8/2000 | Jamieson |
| 6,105,468 | A | | 8/2000 | Fohrman et al. |
| 6,212,721 | B1 | | 4/2001 | Borodulin |
| 6,276,013 | B1 | | 8/2001 | Hansen |
| 6,311,580 | B1 | | 11/2001 | Nagy |

(Continued)

OTHER PUBLICATIONS

Zyliss Can Opener, 4-N-1; "20325 Zyliss Can Opener, 4-N-1". Advertisement at J.E.S. Restaurant Equipment webpage, 1 pages. Undated.

*Primary Examiner* — David B Thomas
(74) *Attorney, Agent, or Firm* — Jansson Munger McKinley & Shape Ltd.

(57) ABSTRACT

An improved combination beverage-container opener device which, in additional to providing easy removal of bottle caps and lifting of stay-on tabs to open beverage cans, provides easy, quick and full removal of stay-on tabs.

20 Claims, 8 Drawing Sheets

(56) References Cited

U.S. PATENT DOCUMENTS

| | | | |
|---|---|---|---|
| 6,957,599 | B2 | 10/2005 | Corredor et al. |
| 7,004,049 | B2 | 2/2006 | So |
| 7,240,589 | B2 | 7/2007 | Kehoe |
| 7,363,837 | B1 | 4/2008 | Odell |
| 7,827,884 | B2 | 11/2010 | Lawson |
| 2005/0252343 | A1 | 11/2005 | Turner |

* cited by examiner

THREE-FUNCTION BEVERAGE-CONTAINER OPENER DEVICE

RELATED APPLICATION

This application claims the benefit of Provisional Application Ser. No. 61/576,285, filed Dec. 15, 2011, the contents of which are incorporated herein.

FIELD OF THE INVENTION

The present invention relates to combination beverage-container opener devices and, more specifically, to such devices which can open bottle caps and open stay-on-tab beverage containers.

BACKGROUND OF THE INVENTION

Countless billions of beverage containers, typically for individual consumption, are opened annually in the United States and elsewhere, with hundreds of millions of beverage containers being opened daily. Thus, there has been considerable attention to development of devices facilitating the opening of beverage containers, the great majority of which are either cans with finger-operated tabs or bottles with pry-off bottlecaps.

Removable pull-off tabs of beverage cans posed two significant problems. When removed from containers, the pull-off tabs created sharp edges along the tab perimeters which could cause injury, primarily cut fingers. Also, such sharp edges could cut through trash bags, and thus potentially exacerbate the risks and problems. Of greatest concern, however, was that removed pull-off tabs contributed to general littering of yards, parks, parking areas and the like.

Therefore, for some time now so-called stay-on-tabs have been the standard mechanism for manual opening of beverage containers. Stay-on-tabs include a small ring portion through which a rivet secures the stay-on tab to the center of the top of the beverage can. The bulk of the stay-on tab is a fairly rigid, finger-liftable portion which, when lifted at a finger-engageable end, pivots with respect to the small ring portion such that a forward portion of the stay-on tab moves downwardly on top of a scored portion of the container top to push it inwardly, thereby creating an opening for beverage flow. Both the inwardly-pushed portion of the container top and the stay-on tab remain with the container top, and so avoid the above-described problems of removable tabs.

One drawback of stay-on-tabs is the problem sometimes encountered by a user, particularly a user with weak fingers, long fingernails, or fingers with wide fingertips. This drawback has at least been addressed by certain prior developments in the field of beverage-can openers.

Another problem of stay-on tabs, however, is related to the fact that the key advantage of stay-on tabs is the fact that they stay on. More specifically, in recent years the removal and collection of large quantities of tabs has been used as a mechanism for providing credits for various commercial or charitable purposes, which may involve financial awards for various causes and purposes. Because of this, when it comes to stay-on tabs, which are the dominant (nearly universal) form of tabs used for beverage containers today, large numbers of beverage consumers repeatedly bend stay-on tabs until the metal adjacent to the small ring-like portion thereof (through which the rivet secures the tab to the top of the beverage can) fractures, in effect causing removal of the tab. This removal process is not only a bit time-consuming and inconvenient, but nearly always leaves a ragged, sharp metal edge on the container top which can pose safety concerns.

A great variety of beverage-container openers have been invented and developed, including a number which are combination opener devices, i.e., devices capable both of removing bottle caps and lifting stay-on tabs to press open the scored portions of the tops of beverage cans. Certain of such combination opener devices are of a type having a first end portion for bottlecap removal, a second end portion for lifting stay-on tabs of beverage cans (to open the cans), and an intermediate handle portion therebetween. In certain of such devices, the first end portion has a cap-receiving opening defined in part by (a) a lifting-edge section engageable with the cap under-edge and (b) an opposite holding-edge section engageable with the cap top-surface, and the second end portion has a tab-receiving slot.

These devices, however, are not developed or configured to also allow easy, complete, and therefore clean and safe removal of stay-on tabs. Their configurations are such that they would interfere with or make difficult their use, particularly by users with fairly weak hands and fingers for any tab removal purpose—even if a user might have intended such purposes. In addition, even in such a hypothetical situation, the structures of such prior combination devices fall far short of that which would facilitate operations.

Such combination beverage-container opener devices of the prior art tend to be of fairly complex construction, which means that production thereof tends to entail more cost than may be desirable for such simple tools.

OBJECTS OF THE INVENTION

It is an object of the invention to provide an improved combination beverage-container opener device which overcomes the problems and shortcomings of the prior art, including those referred to above.

Another object of the invention is to provide an improved combination beverage-container opener device which serves beverage-container opening functions but also serves to easily and cleanly remove stay-on tabs from beverage cans.

Another object of the invention is to provide an improved combination beverage-container opener device which is a single piece, low-cost construction that nonetheless provides all the advantages of container opening and stay-on tab removal with minimum exertion and strain by the user.

Another object of the invention is to provide an improved combination beverage-container opener device which is made by metal stamping operations.

Another object of the invention is to provide an improved combination beverage-container opener device which gives excellent leverage to facilitate removal of stay-on tabs.

Another object of the invention is to provide an improved combination beverage-container opener device which allows easy removal of stay-on tabs without fracturing metal and without leaving sharp, ragged edges.

Another object of the invention is to provide an improved combination beverage-container opener device which allows full visual confirmation of the stay-on tab engagement sufficient for fully removing stay-on tabs.

How these and other objects are accomplished will become apparent from the following descriptions and the drawings.

SUMMARY OF THE INVENTION

The present invention is an improvement in combination-type beverage-container-opening devices of the type that include opposite container-opening ends including a first bottlecap-removing end portion and a second opposite stay-on-tab-lifting end portion for beverage cans, with an intermediate handle portion therebetween.

More specifically, the invention is an improvement in such combination beverage-container opener devices of this type in which: the first end portion has a cap-receiving opening defined in part by (a) a lifting-edge section engageable with the cap under-edge and (b) an opposite holding-edge section engageable with the cap top-surface; and the second end portion has a tab-receiving slot. In the present improvement, the opener device is an elongate single flat metal plate that (1) is of sufficient width at the first end portion to define the cap-receiving opening, (2) is of substantially the same width along the intermediate handle portion, and (3) is inwardly tapered at the second end portion toward a flat central part, the second end portion also having a pair of inwardly-turned opposed wings over the flat central part that together therewith form the tab-receiving slot. The invention, as explained further below, is a three-function beverage-container opener device, which not only serves to easily remove bottlecaps and lift stay-on tabs of beverage cans for purposes of opening them, but also to fully and cleanly remove the stay-on tabs for all the purposes for which such tabs are removed by millions of beverage can users.

This invention provides a three-function beverage-container opener device which overcomes the problems and shortcomings discussed above, provides significant advantages readily recognized by users, and fulfills the objects of the invention referred to above.

In certain highly preferred embodiments, the combined cross-dimensions of the wings of the second end portion and its flat central part total no more than about the width of the first end portion and handle portion. This has a material-saving and related cost advantage. Preferably, the wings have distal ends spaced from one another. This is a feature which allows visual observation of the extent to which a stay-on tab is received into the tab-receiving slot of the opening device when the device is pushed onto the tab; full reception of the tab into the slot is typically essential to assure complete removal of the stay-on tab, leaving only the rivet in place. Complete removal eliminates any remaining sharp metal edges, and so provides a safety benefit.

In highly preferred embodiments, the flat central part of the second end portion is substantially coplanar with the first end portion and the handle portion, and terminates in a beveled leading edge to facilitate fully receiving the stay-on tab within the slot until full contact with the rivet by which the stay-on tab is secured to the container. This feature helps rotation of the handle to fully remove all portions of the stay-on tab, including the rivet-surrounding ring thereof. With such leading-edge bevel, the feature of having the distal ends of the wings spaced from one another is particularly effective to facilitate visual observation of contact by such edge with the rivet. And, with the bevel facing downwardly, the edge portion facilitates rivet removal by twisting the beverage-container opening device.

Preferred dimensioning of the opener device is helpful in operation of the second end of the opener device in removing stay-on tabs as a part of can opening. In preferred embodiments, the width of the handle portion is greater than about 3.5 cm and the combined length of the handle portion and first end portion is sufficient for full-hand grasping by a typical adult. Such substantial width of the handle portion and the first end portion provides important leverage allowing users with weak hands and fingers to easily remove stay-on tabs by rotating the opener device.

Preferred shaping is also important to allow easy use of the opener device of the invention. More specifically, the tapering of the second end portion is such that, with the stay-on tab fully inserted into the slot, the opposite edges of the opener device cross the circular rim of a beverage can of substantially standard diameter at positions such that the two crossing points circumscribe an angle of less than about 60° of the circular rim of the container top. Angles of less than about 60° facilitate easy removal of the stay-on tab by rotation of the handle, because one of such rim contact points provides an effective fulcrum to apply tab-removal force during rotation of the opener device.

In such preferred embodiments, it is most preferred that the width of the handle portion be greater than about 3.5 cm and that the combined length of the handle portion and first end portion be sufficient for full-hand grasping by a typical adult. In such situations, the tapering of the second end portion is such that the width of the opener device at the two crossing points of the rim is less than about 2.5 cm.

It is highly preferred that the opener device of this invention be a flat metal plate formed by stamping. Thus, all of the above advantages of the invention are provided in a single, flat metal plate formed by metal stamping processes. In such embodiments, it is preferred that the lifting-edge section of the first end portion, used for removing beverage bottlecaps, is thinner than the opposite holding-edge section. Also, it is preferred that the edge of the lifting-edge section be convex to facilitate insertion under the bottlecap under-edge.

Another aspect of this invention is the method of using the opener device described above for fully removing all portions of stay-on tabs of easy-open beverage cans. More specifically, the method includes providing such a device, pushing the second end portion thereof onto the stay-on tab such that the tab is fully received into the slot, lifting the first end of the opener device to open the beverage can, and thereafter lowering the handle portion and, with one edge portion of the tapered second end portion contacting the rim of the can, rotating the handle portion until such rotation fully removes all portions of the stay-on tab including the rivet-surrounding ring thereof. The method of this invention does not require that there be a bottlecap-opening end; the stay-on-tab-removing end and the adjacent handle portion, each satisfying the characteristics described above, are sufficient for the method of this invention.

Several of the preferred features of the opener device described above are helpful to this inventive method.

Given that the combination beverage-container opening device is an elongate flat metal plate, and further given that the width of the handle portion thereof is similar to the width of the necessarily wide first end portion used for removing bottlecaps, one or both of the opposed surfaces of the intermediate handle portion (and even immediately-adjacent portions of the device) are readily usable for placement of logos or the like by beverage or other companies. Such logos and the like, indeed, can be put on such surfaces by the metal-stamping process itself, by application of decals, or in other well-known ways.

The terms used in this patent application will be easily and accurately understood by persons of ordinary skill in the art without reference to extraneous materials. However, it should be noted that the term "fully-inserted," when used with reference to the extent to which a stay-on tab is received into the slot at the second end portion of the opener device, means that the leading edge of the second end portion has reached the rivet by which the stay-on tab is secured to the top of the can.

DETAILED DESCRIPTION OF PREFERRED EMBODIMENTS

Figure 1:
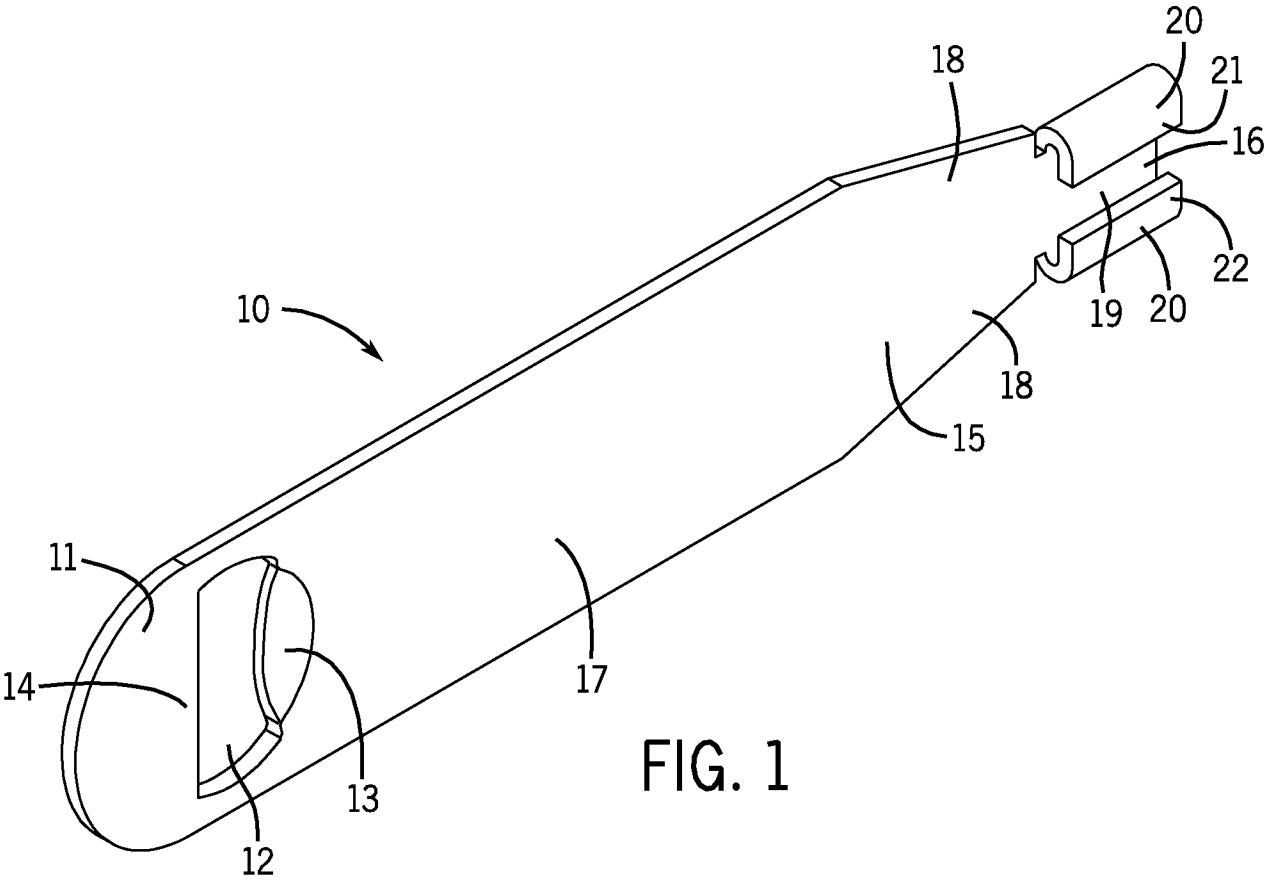
FIG. 1 is a perspective top view of a combination three-function beverage-container opener device which is a preferred embodiment of this invention.
Figure 2:
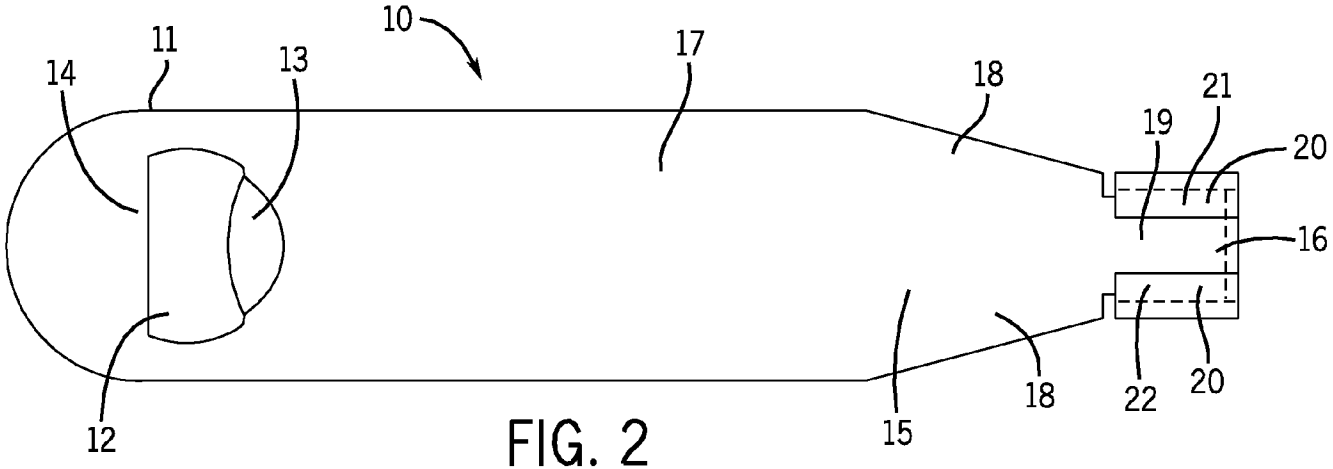
FIG. 2 is a top plan view of the opener device.
Figure 3:
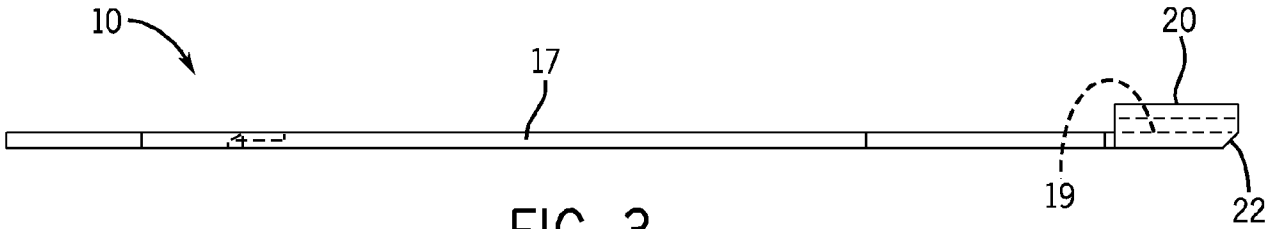
FIG. 3 is a side elevation.

FIGS. 1-10 illustrate a preferred three-function beverage-container opener device 10 in accordance with this invention, and its method of operation in removal of stay-on tabs.

Opener device 10 is an elongate single flat metal plate which includes a first end portion 11 forming a bottlecap-receiving opening 12. Opening 12 is defined by an edge which includes a lifting-edge section 13 engageable with an under-edge of a bottlecap (not shown) and an opposite holding-edge section 14 engageable with a bottlecap top-surface. First end portion 11 is used to remove bottlecaps in the normal, well-known manner. Opener device 10 further includes a second end portion 15 forming a tab-receiving slot 16. Opener device 10 also includes an intermediate handle portion 17 between first and second end portions 11 and 15.

Intermediate handle portion 17 is of substantially the same width as first end portion 11, and such width is substantial given the bottlecap-receiving requirements of first end portion 11. Second end portion 15 includes an inwardly-tapered portion 18 which is contiguous with and extends from handle portion 17 to a flat central part 19. The tapering and dimensioning of tapered portion 18 is important to facilitate easy removal of stay-on tabs.

Figure 4:
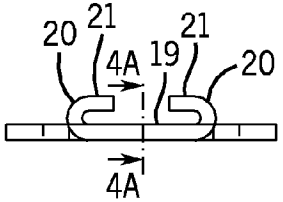
FIG. 4 is a second-end elevation.

A pair of inwardly-turned opposed wings 20, which are part of the metal plate, extend over flat central part 19, and together with flat central part 19 form tab-receiving slot 16. As best seen in FIG. 4, wings 20 have distal ends 21 spaced from one another, and this provides a viewing area from the top side of opener device 10 to allow the user to see the extent to which a stay-on tab is received into slot 16 when the device is pushed onto the tab.

Figure 4A:
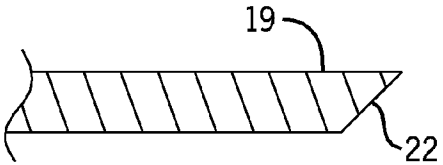
FIG. 4A is a sectional detail view taken along section 4A-4A as indicated in FIG. 4.

Flat central part 19 has a leading edge portion which is beveled. The beveled leading edge portion is identified by numeral 22 in FIGS. 3 and 4A. The beveling facilitates full insertion of second end 15 of opener device 10 until the distal edge of beveled edge portion 22 reaches contact with the rivet 24 which secures the stay-on tab 26 to the top of the can.

FIGS. 5-10 illustrate operation of opener device 10 for purposes of opening a can and fully removing the stay-on tab.

Figure 5:
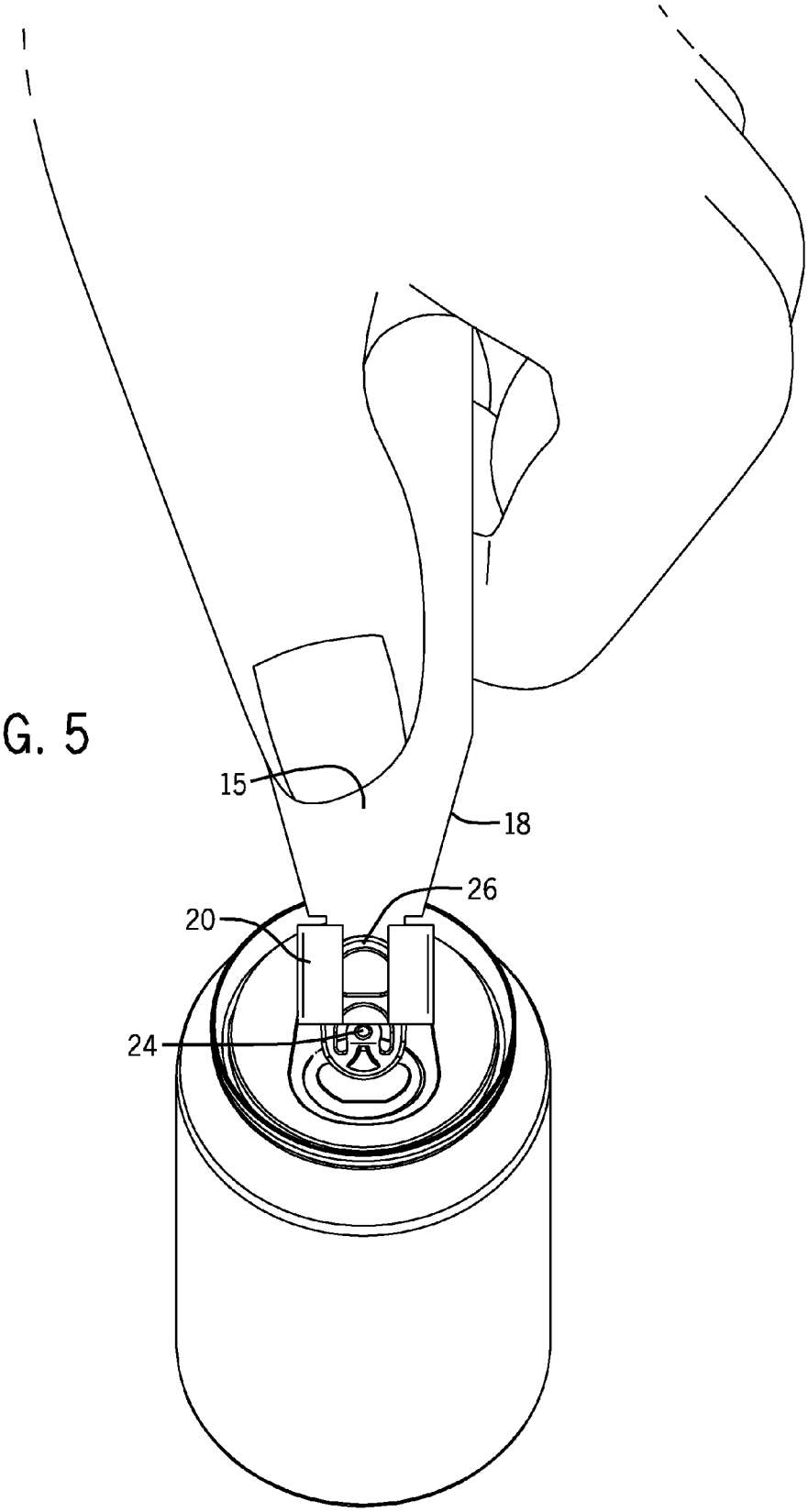
FIG. 5 is a perspective view showing the preferred opener device fully-engaging a stay-on tab.

FIG. 5 shows opener device 10 with second end portion 15 having been manually positioned such that the stay-on tab 26 is fully inserted into tab-receiving slot 16—i.e., with the distal end of beveled leading edge portion 22 engaged against rivet 24. Numerals are not deemed necessary to refer to portions of the can.

Figure 6:
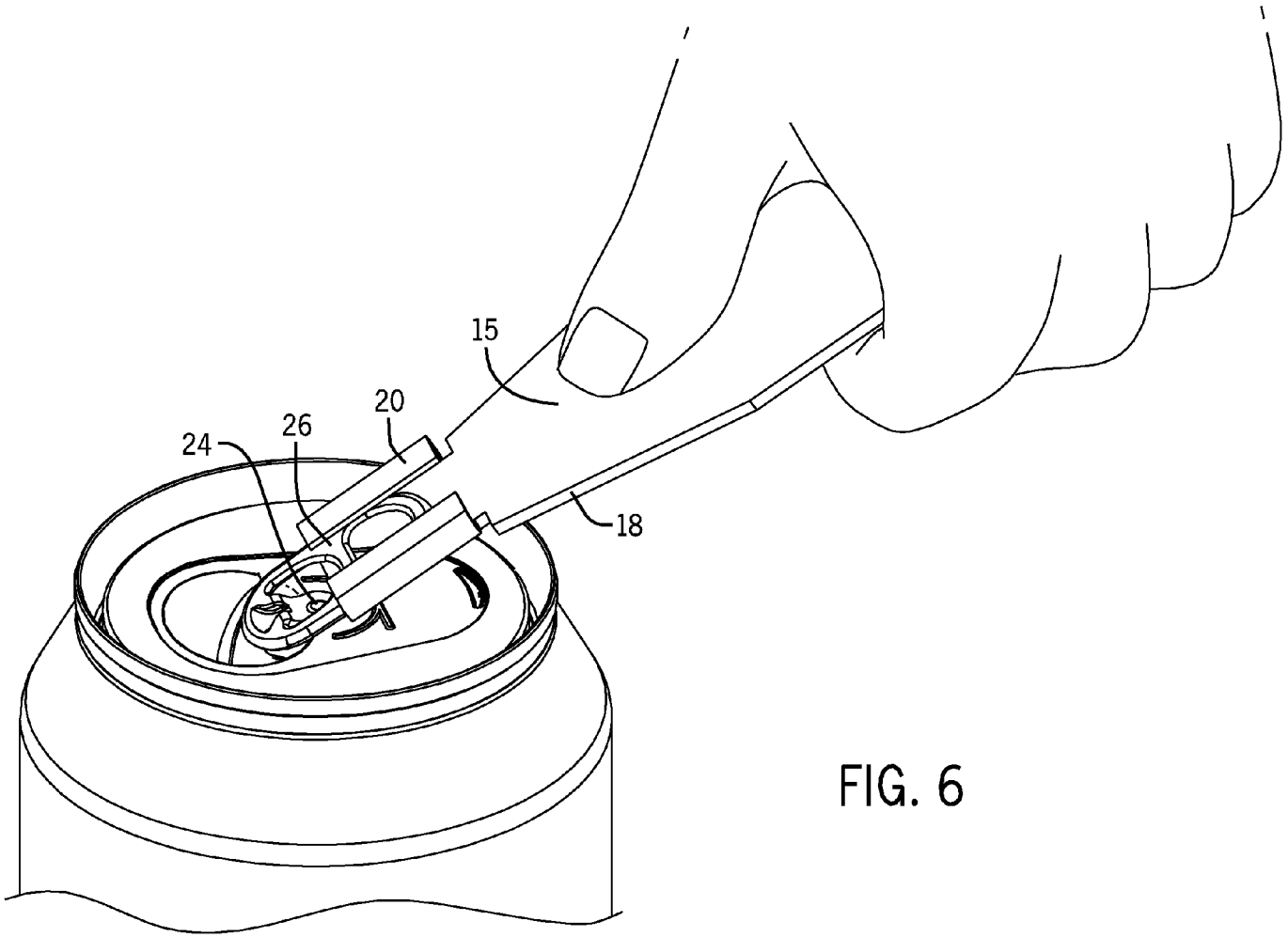
FIG. 6 is a perspective view showing the device lifting the stay-on tab to open the can.
Figure 7:
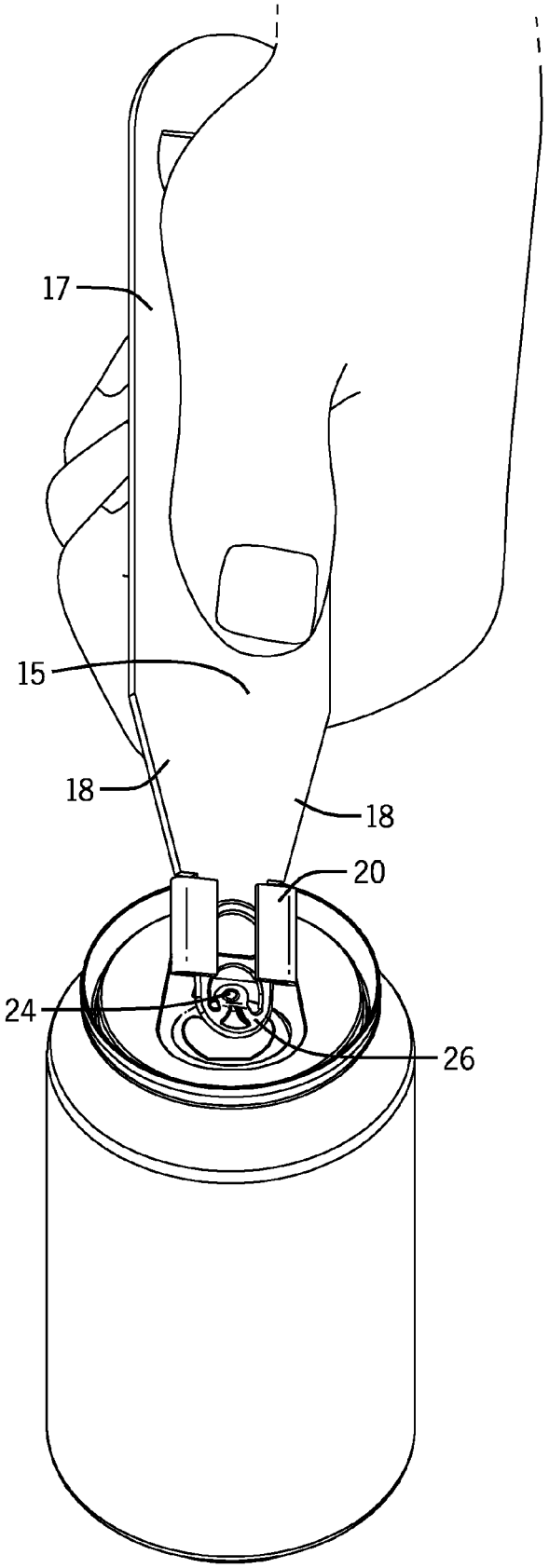
FIGS. 7 and 8 are sequential perspective views showing rotation of the opener device for removal of the stay-on tab.
Figure 8:
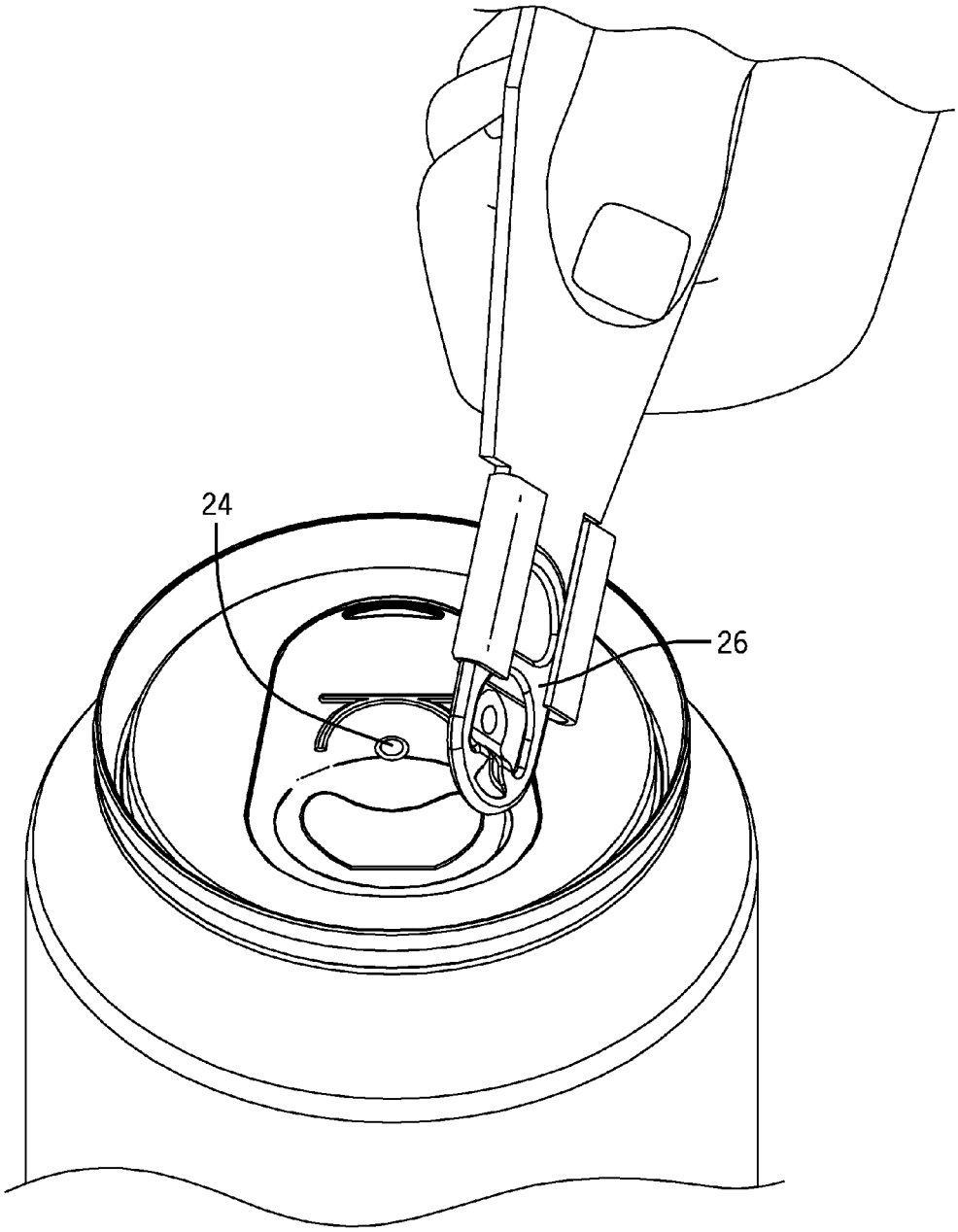

FIG. 6 illustrates the lifting action of opener device 10 which serves to open the can. FIG. 7 shows the beginning of the subsequent motion of rotating opener device 10 with one of the tapered edges 18 with second end portion 15 engaged with the rim of the can. As is apparent from FIG. 7, the dimensioning of opener device 10, including the tapering of second end portion 15, is such that an angle of less than about 60° of the circular rim of the container top would be circumscribed between the two crossing points of tapered edges 18. This combination of the dimensioning and the widths of tapered portion 18 and handle portion 17 provide very favorable fulcrum and leverage action for easy and complete removal of stay-on tab 26. FIG. 8 shows the rotation motion as it is being completed, to remove stay-on tab 26.

Figure 9:
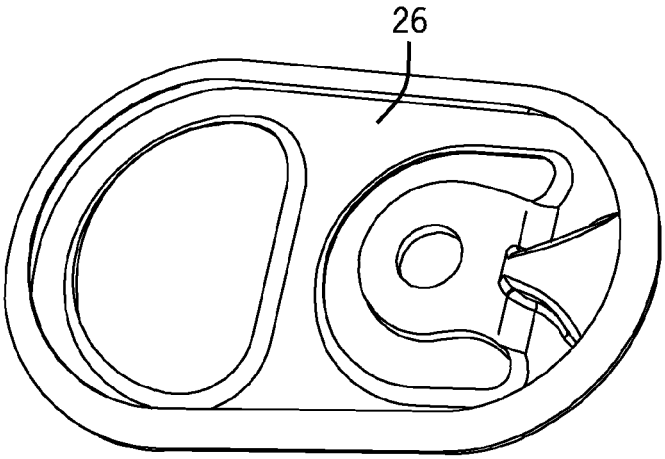
FIG. 9 is a perspective view showing the removed stay-on tab with its small rivet-surrounding ring portion intact.
Figure 10:
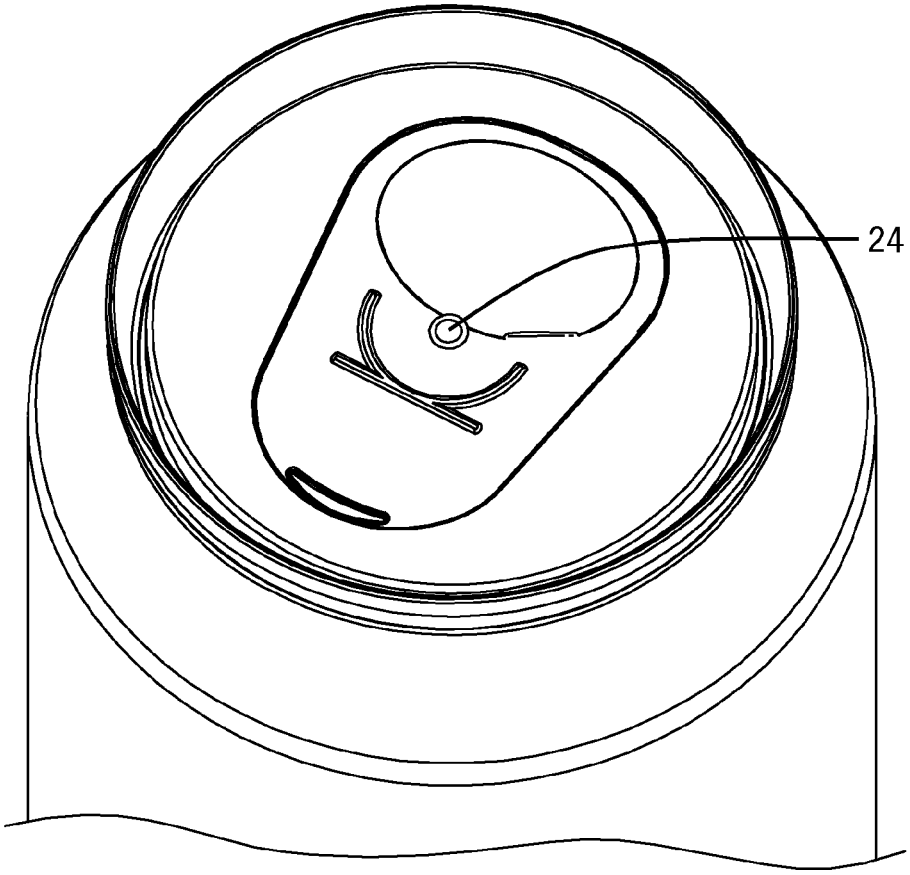
FIG. 10 is an enlarged perspective view of the top of a container after full removal of the stay-on tab.
Figure 11:
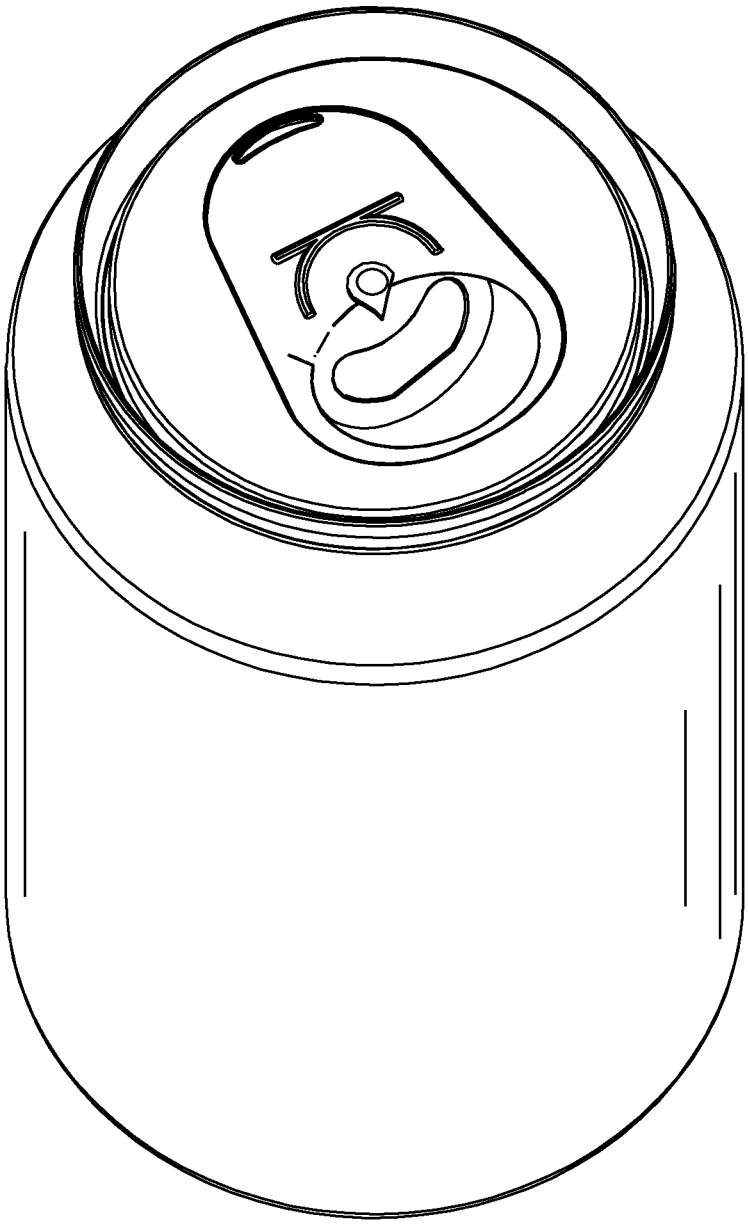
FIG. 11 (PRIOR ART)
FIG. 11 represents the prior art in that it shows a can after removal of the stay-on tab by repeated bending, which leaves a sharp exposed metal edge.

As stated above, FIGS. 9 and 10, showing the removed stay-on tab 26 and the top of the can after its removal, show certain of the advantages of this invention. In contrast, FIG. 11 illustrates one of the several problems solved by this invention, i.e., the ragged, sharp edge of whatever portion of the stay-on tab is left when it has been removed by repeated bending.

Highly preferred embodiments of the opener device of this invention may easily be manufactured from a single metal plate by stamping processes. Furthermore, the dimensioning of preferred forms of this invention, such as opener device 10 seen in the figures, facilitates manufacture by maximizing the number of duplicate products that may be produced from a metal plate. One factor that is helpful in this regard is that, with preferred dimensioning, the combined cross dimensions of wings 20 and flat central part 19 are such that before the wings are bent into their final positions during manufacture, the width of the metal at that point is no greater than, and in fact can be identical to the width of opener device 10 at its widest point—i.e., at first end portion 11 and handle portion 17. And, as indicated above, metal stamping can also be used to inscribe logos and other graphic information on the device.

While the principles of the invention have been shown and described in connection with specific embodiments, it is to be understood that such embodiments are by way of example and are not limiting.

The invention claimed is:

1. In a combination beverage-container opener device including a first bottlecap-removing end portion, a second opposite stay-on-tab-lifting end portion for beverage cans, and an intermediate handle portion, the first end portion having a cap-receiving opening defined in part by (a) a lifting-edge section engageable with the cap under-edge and (b) an opposite holding-edge section engageable with the cap top-surface, and the second end portion having a tab-receiving slot, the improvement wherein the opener device is an elongate single flat metal plate that (1) is of sufficient width at the first end portion to define the cap-receiving opening, (2) is of substantially the same width along the intermediate handle portion, and (3) is inwardly tapered at the second end portion toward a flat central part, the second end portion also having a pair of inwardly-turned opposed wings over the flat central part that together therewith form the tab-receiving slot.

2. The opener device of claim 1 wherein the combined cross-dimensions of the wings and the flat central part total no more than about the width of the first end portion and handle portion.

3. The opener device of claim 2 wherein the wings have distal ends spaced from one another.

4. The opener device of claim 1 wherein the flat central part is substantially coplanar with the first end portion and the handle portion, and terminates in a beveled leading edge to facilitate fully receiving the stay-on tab within the slot until full contact with the rivet by which the stay-on tab is secured to the container, such that subsequent rotation of the handle fully removes all portions of the stay-on tab including the rivet-surrounding ring thereof.

5. The opener device of claim 4 wherein the wings have distal ends spaced from one another, thereby allowing visual observation of fully receiving the stay-on tab until contact of the beveled leading edge with the rivet.

6. The opener device of claim 1 wherein the width of the handle portion is greater than about 3.5 cm and the combined length of the handle portion and first end portion is sufficient for full-hand grasping by a typical adult.

7. The opener device of claim 1 wherein the tapering of the second end portion is such that, with the stay-on tab fully inserted into the slot, the opposite edges of the opener device cross the circular rim of a beverage-can of substantially standard diameter such that the two crossing points circumscribe an angle of less than about 60° of the circular rim of the top of the can, thereby to facilitate easy removal of the stay-on tab by rotation of the handle.

8. The opener device of claim 7 wherein the width of the handle portion is greater than about 3.5 cm and the combined length of the handle portion and first end portion is sufficient for full-hand grasping by a typical adult.

9. The opener device of claim 8 wherein the tapering of the second end portion is such that the width of the opener device at the two crossing points is less than about 2.5 cm.

10. The opener device of claim 1 wherein the flat metal plate is formed by stamping.

11. The opener device of claim 10 wherein the lifting-edge section of the first end portion is thinner than the holding-edge section.

12. The opener device of claim 11 wherein the edge of the lifting-edge section is convex to facilitate insertion under the bottlecap under-edge.

13. A method for fully removing all portions of stay-on tabs of easy-open beverage cans comprising:

providing a combination beverage-container opener device including a first bottlecap-removing end portion, a second opposite stay-on-tab-lifting end portion for beverage cans, and an intermediate handle portion, the first end portion having a cap-receiving opening defined in part by (a) a lifting-edge section engageable with the cap under-edge and (b) an opposite holding-edge section engageable with the cap top-surface, and the second end portion having a tab-receiving slot, the opener device being an elongate single flat metal plate that (1) is of sufficient width at the first end portion to define the cap-receiving opening, (2) is of substantially the same width along the intermediate handle portion, and (3) is inwardly tapered at the second end portion toward a flat central part, the second end portion also having a pair of inwardly-turned opposed wings over the flat central part that together therewith form the tab-receiving slot;

pushing the second end portion of the opener device onto the stay-on tab such that the tab is fully received into the slot;

lifting the first end of the opener device to open the beverage can; and thereafter lowering the handle portion and, with one edge portion of the tapered second end portion contacting the rim of the can, rotating the handle portion until such rotation fully removes all portions of the stay-on tab including the rivet-surrounding ring thereof.

14. The method of claim 13 wherein the flat central part is substantially coplanar with the first end portion and the handle portion, and terminates in a beveled leading edge to facilitate fully receiving the stay-on tab within the slot until full contact with the rivet by which the stay-on tab is secured to the container.

15. The method of claim 14 wherein the wings have distal ends spaced from one another, thereby allowing visual observation of fully receiving the stay-on tab until contact of the beveled leading edge with the rivet.

16. The method of claim 13 wherein the width of the handle portion is greater than about 3.5 cm and the combined length of the handle portion and first end portion is sufficient for full-hand grasping by a typical adult.

17. The method of claim 13 wherein the tapering of the second end portion is such that, with the stay-on tab fully inserted into the slot, the opposite edges of the opener device cross the circular rim of a beverage-can of substantially standard diameter such that the two crossing points circumscribe an angle of less than about 60° of the circular rim of the top of the can, thereby to facilitate easy removal of the stay-on tab by rotation of the handle.

18. The method of claim 17 wherein the width of the handle portion is greater than about 3.5 cm and the combined length of the handle portion and first end portion is sufficient for full-hand grasping by a typical adult.

19. The method of claim 18 wherein the tapering of the second end portion is such that the width of the opener device at the two crossing points is less than about 2.5 cm.

20. A method for fully removing all portions of stay-on tabs of easy-open beverage cans comprising:

providing a beverage-can opener device including a stay-on-tab-lifting end portion with a tab-receiving slot, and an adjacent handle portion, the opener device being an elongate single flat metal plate with the handle portion having a width greater than about 3.5 cm and a length sufficient for full-hand grasping by a typical adult, the stay-on-tab-lifting end portion being inwardly tapered from the handle portion to terminate at a flat central part, the end portion also having a pair of inwardly-turned opposed wings over the flat central part that together therewith form the tab-receiving slot;

pushing the end portion of the opener device onto the stay-on-tab such that the tab is fully received into the slot;

lifting the opener device to open the beverage can; and thereafter lowering the handle portion and, with one edge portion of the tapered second end portion contacting the rim of the can, rotating the handle portion until such rotation fully removes all portions of the stay-on tab including the rivet-surrounding ring thereof.

* * * * *